United States Patent [19]

Coleman

[11] 3,942,347

[45] Mar. 9, 1976

[54] KEY LOCATING ATTACHMENT FOR CONTROLLING THE DEPTH OF PENETRATION OF A KEY INTO A LOCK

[76] Inventor: Marvin Witham Coleman, 4038 Poplar St., Fairfax, Va. 22030

[22] Filed: Oct. 29, 1974

[21] Appl. No.: 518,741

[52] U.S. Cl. ..... 70/395; 70/408

[51] Int. Cl.[2] ..... E05B 19/04

[58] Field of Search ..... 70/395, 397, 398, 408, 70/411

[56] References Cited

UNITED STATES PATENTS 2,662,390 12/1953 Michnoff ..... 70/395 X

FOREIGN PATENTS OR APPLICATIONS 1,398,889 4/1965 France ..... 70/397

*Primary Examiner*—Robert L. Wolfe

*Attorney, Agent, or Firm*—Shlesinger, Arkwright, Garvey & Dinsmore

[57] ABSTRACT

A key locating attachment for controlling the depth of penetration of a key into a lock. This attachment is engaged with the key and a portion thereof engages the face of the lock when the key is placed therein to align the complemental parts of the key and the lock to actuate the same. The attachment is adjustably fixed to the key in order to permit adjustment thereof to compensate for wear on the bearing surfaces of the lock and key which would otherwise cause misalignment of the interengaging parts of the key and the lock.

7 Claims, 8 Drawing Figures

Fig. 1
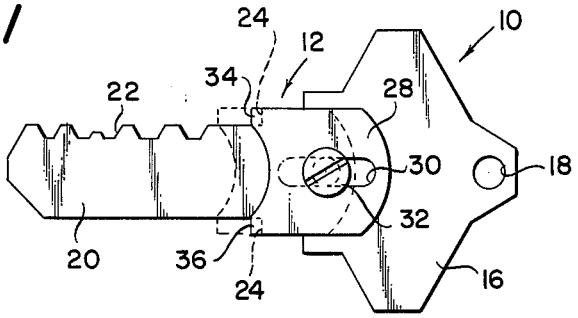
Fig. 2
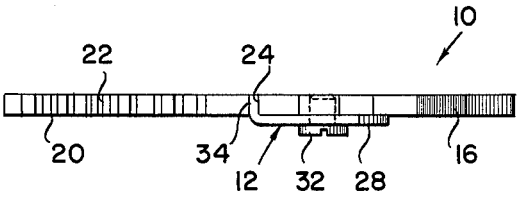
Fig. 3
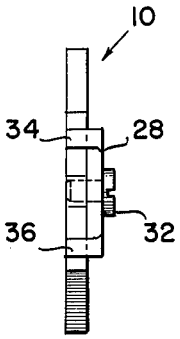
Fig. 4
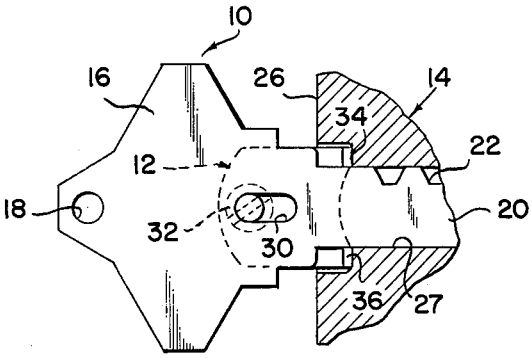
Fig. 5
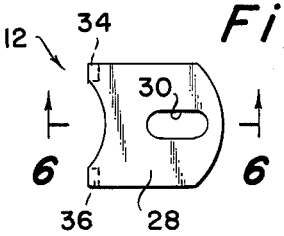
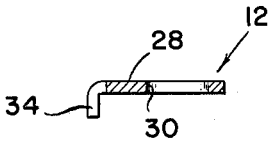
Fig. 6
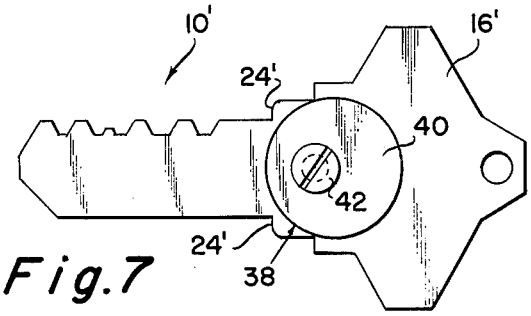
Fig. 7
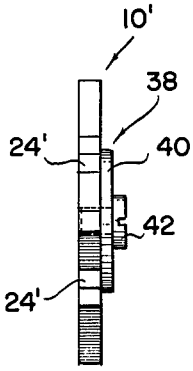
Fig. 8

KEY LOCATING ATTACHMENT FOR CONTROLLING THE DEPTH OF PENETRATION OF A KEY INTO A LOCK

BACKGROUND AND OBJECTS

Conventional pin-tumbler cylinder locks comprise a cylinder having a series of pins which are actuated in a well known manner by a key having matching serrations, to lock and unlock the same. These locks are usually made of relatively soft, non-ferrous metals because of the low corrosion and self-lubricating characteristics thereof. The design of most locks is such that the tumbler-lifting key serrations and the tumbler pins of the lock must be closely aligned in order to effect ready turning of the key in the lock cylinder for lifting the tumblers. Keys are conventionally provided with a shoulder or stop for engaging the face of the lock when the key has been inserted into the lock to a depth to effect the alignment of the key serrations and tumbler pins.

Due to the softness of the metals employed for the key and the lock, rapid wear occurs at the bearing point of the key shoulder and the lock. This produces misalignment between the key serrations and the tumbler pins producing difficulties in attempting to actuate the lock. A new key will not correct this condition since the wear occurs on the face of the lock cylinder as well as the key itself. Therefore, when this occurs, it has been standard practice to discard the entire lock cylinder and key and install a replacement.

It is an object of this invention to provide a key locating attachment for controlling the depth of penetration of a key into a lock in order to effect alignment between the operating parts of the key and the lock for repeatedly actuating the same with ease.

Another object is to provide an attachment of the character described wherein the attachment is longitudinally movably mounted on a key in order to adjust the working depth of entry thereof into the lock to compensate for wearing of parts of the key and lock.

A further object is to provide an attachment of the character described which is of simple, economic construction, and which may be readily attached to a standard key.

Other objects will be apparent from the following description of the presently preferred forms of this invention taken together with the appended drawings.

DESCRIPTION OF FIGURES OF THE DRAWINGS

FIG. 1 is a side elevational view of the elevation of the key locking attachment for controlling the depth of penetration of a key into a lock, illustrating its application;

FIG. 2 is a top elevational view of the same;

FIG. 3 is an end elevational view of the same;

FIG. 4 is a fragmentary side elevational view similar to FIG. 1 illustrating the key with attachment connected thereto and inserted into a lock;

FIG. 5 is a side elevational view of the attachment of the present invention per se;

FIG. 6 is a sectional view taken along the line 6—6 of FIG. 5, looking in the direction of the arrows;

FIG. 7 is a side elevational view similar to FIG. 1 but showing a modified form of the present invention; and FIG. 8 is an end elevational view of the form of invention illustrated in FIG. 7.

DESCRIPTION OF FORM OF INVENTION ILLUSTRATED IN FIGS. 1 TO 5

In FIGS. 1 to 5, there is illustrated a key generally designated 10 having a key locating attachment 12 for controlling the depth of penetration of a key into a lock which is generally designated 14.

Key 10 includes a head portion 16 having a key ring opening 18. Head portion 16 is reduced in width to provide a shank portion 20 having a series of milled serrations 22 along one edge in accordance with standard procedure. The reduction in width of head portion 16 forms a shoulder or stop 24 which normally abuts the face 26 of lock 14 to limit the depth of penetration of shank 20 into keyhole 27 of the lock and thereby align serrations 22 with the pins (not shown) of the lock.

In accordance with the objects of the present invention, attachment 12 includes a flat plate 28 provided with a central elongated slot 30 through which a shank of a set screw 32 passes and threadedly engages head portion 16 of key 10. Plate 28 is in contiguous relation with the face of head portion 16 of the key, the forward portion of which plate is bent at substantially a right angle to the main portion to provide flanges 34 and 36 which are spaced apart a distance approximating the width of shank portion 20 of the key. As shown to advantage in FIGS. 2 and 3, flanges 34 and 36 are aligned with, and located in advance of, shoulder 24, the length of said flanges being substantially the same as the thickness of key 10.

Attachment 12 is preferably constructed of steel or other hard and durable material, and the flanges thereof serve to shield the key from wear at the critical depth control bearing point of the key.

In use of the present invention, key 10 with attachment 12 connected thereto is inserted into a cylinder lock, and when the key serrations are aligned with the pins of the lock, set screw 32 is loosened to permit rectilinear movement of plate 28 longitudinally towards the face of the lock of the cylinder lock. When flanges 34 and 36 engage the face of the cylinder lock, set screw 32 is tightened to fix the position of the attachment relative to the key. Thereafter, key 10 may be inserted into the lock and turned immediately without delay or longitudinal manipulation of the key within the lock. subsequent adjustment of the present attachment may be made as wearing of the parts of the key and lock demand.

DESCRIPTION OF THE FORM OF INVENTION ILLUSTRATED IN FIGS. 7 AND 8

In FIGS. 7 and 8, there is illustrated a modified form of the present invention and generally includes a key 10' and a key locating attachment 38. Key 10' is similar in construction to that shown in the form of invention illustrated in FIGS. 1 to 6 and like parts are accordingly identified by like, primed numbers.

In this form of the invention, however, attachment 38 is in the form of a flat, circular cam 40 which is affixed to head portion 16' by a set screw 42 which passes eccentrically through flat cam 40 and is threadedly engaged with head portion 16'. By virtue of the eccentric mounting of cam 40, upon rotation thereof, the peripheral portion thereof extends in the direction of the lock-engaging portion of the key, the periphery of the cam extending beyond shoulders 24' of the key to engage the face of the lock.

When key 10' is inserted into the cylinder lock, and protuberances 22' are aligned with the tumbler pins, cam 38 is rotated until a portion of the peripheral surface thereof engages the face of the cylinder lock, following which set screw 42 is tightened, to retain the cam in the adjusted position.

With the attachment of the present invention, simple and economic means are readily provided for standard lock keys for accurately and precisely controlling the depth of penetration of a key into a lock. This attachment further compensates for any wear either to the lock itself, or the key producing misalignment of the operating parts which would otherwise produce difficulty in actuating the lock and eventually result in discarding of the key and lock cylinder. With this invention also, means are provided for repeatedly adjusting the depth of penetration of the key by virtue of the adjustable feature of the attachment, thereby extending the life of the key and cylinder lock an indefinite period of time.

While there has been herein shown and described the presently preferred forms of this invention, it is to be understood that such has been done for purposes of illustration only and that various changes may be made therein within the scope of the appended claims.

What I claim is:

1. In a key having a head portion, shoulder and shank portion, an attachment to vary the working depth of the key in a cylinder lock, said attachment including:

a. a key locating member, b. said key locating member comprising a flat plate engaged with a face of the key head portion, c. said flat plate being provided with a longitudinal slot, and d. a set screw having a shank extending through the longitudinal slot of said flat plate into threaded engagement with the head portion of the key for securing the flat plate to the key and permitting adjustment of the position of the flat plate with respect to the key, e. portions of said flat plate proximate the shank of the key being extended to provide flanges which are spaced apart a distance approximately substantially equal to the width of the shank of the key, f. said flanges being bent at approximately a right angle to said flat plate, and positioned in alignment with, and in advance of, the shoulder of the key.

2. In a key having a head portion, shoulder, and shank portion, an attachment to vary the working depth of the key in a cylinder lock, said attachment including:

a. a key locating member engaged with a face of the key head portion, b. means for securing said key locating member to the face of the key, c. a portion of said key locating member extending longitudinally of the key beyond the shoulder to a point adjacent the shank portion thereof for engagement with the face of the lock, to limit the depth of penetration of the shank of the key into the lock, and d. means for changing the position of said key locating member longitudinally of the key to adjust the depth of penetration of the shank of the key into the lock in order to compensate for wearing of parts of the key and lock.

3. The attachment of claim 2, wherein:

a. said key locating member includes a flat plate, b. portions of said plate proximate the shank portion of the key being extended to provide flanges which are spaced apart a distance approximately substantially equal to the width of the shank portion of the key, c. said flanges being bent at approximately a right angle to said flat plate, and positioned in alignment with, and in advance of, the shoulder of the key.

4. The attachment of claim 3, wherein:

a. said plate is provided with an enlarged opening through which said means for securing said key locating member to the face of the key extends, whereby adjustment of said flat plate with respect to the key may be effected.

5. In a key having a head portion, shoulder, and shank portion, an attachment to vary the working depth of the key in a cylinder lock, said attachment including:

a. a disc-like member engaged with a face of the key head portion, and b. means for securing said disc-like member to the face of the key, c. a portion of the periphery of said disc-like member extending longitudinally of the key beyond the shoulder to a point adjacent the shank portion thereof for engagement with the face of the lock to limit the depth of penetration of the shank of the key into the lock.

6. The attachment of claim 5, wherein:

a. said disc-like member comprises a cam, and b. said cam is eccentrically mounted on said means for securing said cam to the face of the key, whereby longitudinal adjustment of said cam with respect to the key may be effected by rotation of the former.

7. The attachment of claim 6, wherein:

a. said means for securing said cam to the face of the key is a set screw.

* * * * *